US009416560B2

(12) United States Patent
Guillemet

(10) Patent No.: US 9,416,560 B2
(45) Date of Patent: Aug. 16, 2016

(54) DOOR HANDLE MOUNTING SYSTEM

(75) Inventor: Guy Guillemet, Terrebonne (CA)

(73) Assignee: FERCO ARCHITECTURAL HARDWARE, Laval, Quebec (CA)

( * ) Notice: Subject to any disclaimer, the term of this patent is extended or adjusted under 35 U.S.C. 154(b) by 1611 days.

(21) Appl. No.: 12/110,857

(22) Filed: Apr. 28, 2008

(65) Prior Publication Data

US 2009/0267363 A1 Oct. 29, 2009

(51) Int. Cl.

| | |
|---|---|
| ***E05B 1/00*** | (2006.01) |
| ***E05B 3/06*** | (2006.01) |
| *E05B 3/00* | (2006.01) |
| *E05B 13/00* | (2006.01) |

(52) U.S. Cl.

CPC ..... *E05B 3/06* (2013.01); *Y10T 70/5155* (2015.04); *Y10T 292/57* (2015.04)

(58) Field of Classification Search

CPC ... Y10T 292/85; Y10T 292/82; Y10T 292/93; Y10T 292/96

USPC ..... 292/353, 347, 348, 336.3, 349, 352, 292/358, 359

See application file for complete search history.

(56) References Cited

U.S. PATENT DOCUMENTS

| | | | | | |
|---|---|---|---|---|---|
| 1,706,598 | A * | 3/1929 | Archer | E05B 3/06 | 292/347 |
| 2,860,540 | A * | 11/1958 | Karlsson | F16B 17/002 | 220/233 |
| 4,042,268 | A | 8/1977 | Coglan | | |
| 4,784,418 | A | 11/1988 | Pearson et al. | | |
| 4,998,760 | A * | 3/1991 | Nixon et al. | 292/347 | |
| 5,067,758 | A * | 11/1991 | Fann | E05B 3/065 | 292/244 |
| 5,265,924 | A * | 11/1993 | Kim | 292/336.3 | |
| 5,390,517 | A * | 2/1995 | Yamada | 70/210 | |
| 5,617,749 | A * | 4/1997 | Park | 70/224 | |
| 5,666,833 | A * | 9/1997 | Gao et al. | 70/224 | |
| 6,101,856 | A * | 8/2000 | Pelletier et al. | 70/472 | |
| 6,386,602 | B1 * | 5/2002 | Lan | 292/336.3 | |
| 6,425,273 | B1 * | 7/2002 | Kim et al. | 70/224 | |
| 6,533,336 | B2 * | 3/2003 | Kemp | E05B 3/003 | 16/441 |
| 6,575,006 | B1 * | 6/2003 | Don | 70/472 | |
| 6,644,077 | B1 * | 11/2003 | Huang | 70/468 | |
| 6,880,872 | B2 * | 4/2005 | Eller et al. | 292/357 | |
| 7,073,829 | B2 * | 7/2006 | Kuo et al. | 292/357 | |
| 7,104,098 | B2 * | 9/2006 | Romero | E05B 13/10 | 292/353 |
| 7,137,657 | B2 * | 11/2006 | Wu et al. | 292/357 | |
| 7,143,477 | B2 * | 12/2006 | Dalsing et al. | 16/412 | |
| 7,188,873 | B2 * | 3/2007 | Brown | E05B 3/06 | 292/336.3 |
| 7,387,005 | B2 * | 6/2008 | Huang et al. | 70/467 | |

(Continued)

*Primary Examiner* — Carlos Lugo
*Assistant Examiner* — Faria Ahmad
(74) *Attorney, Agent, or Firm* — Norton Rose Fulbright Canada LLP

(57) ABSTRACT

A door handle mounting system is comprised of a face plate having a handle mounting hole therein to receive a shank portion of a handle therethrough. A circumferential abutment is associated with the handle for abutment about the mounting hole on an outer face of the face plate when the shank portion is disposed thereinto. A retainer ring, formed of flexible non-metallic material having a memory, is adapted to engage with the shank portion adjacent a rear face of the face plate. The retainer ring has an integrally formed locking portion for locking engagement with the shank portion, and an integrally formed tensioning portion for flexible abutment with the rear face of the face plate to apply a pulling force on the shank portion while retaining the handle operationally secured to the face plate. A coupling sleeve is also securable to the shank portion and engageable by the retainer ring.

14 Claims, 6 Drawing Sheets

(56) References Cited

U.S. PATENT DOCUMENTS

| | | | | |
|---|---|---|---|---|
| 7,530,245 | B2 * | 5/2009 | Fan | 70/134 |
| 7,708,489 | B2 * | 5/2010 | Trotter et al. | 403/194 |
| 7,748,759 | B2 * | 7/2010 | Chen et al. | 292/347 |
| 8,746,760 | B2 * | 6/2014 | Chen et al. | 292/357 |
| 8,844,330 | B2 * | 9/2014 | Moon et al. | 70/224 |
| 2001/0026071 | A1 * | 10/2001 | Kemp et al. | 292/348 |
| 2004/0183316 | A1 * | 9/2004 | Walls et al. | 292/336.3 |
| 2009/0146439 | A1 * | 6/2009 | Watts et al. | 292/350 |
| 2015/0013402 | A1 * | 1/2015 | Murphy | 70/141 |

* cited by examiner

DOOR HANDLE MOUNTING SYSTEM

TECHNICAL FIELD

The present invention relates to a door handle mounting system wherein the shank portion of the handle is engaged from a rear face of a face plate by a retainer ring formed of flexible material and having integrally formed therewith a tensioning portion to apply a pulling force on the shank portion to retain the handle operationally secured to the face plate.

BACKGROUND ART

The door handle mounting system of the present invention is of a type as for example illustrated by U.S. Pat. Nos. 4,042,268; 4,784,418; 5,067,758 and 7,188,873. In all of these types of door handle mounting systems, the shank portion of the handle is retained captive behind the face plate by an assembly of washers, connecting plates and retaining lock springs, all of which are formed of metal. These retainer assemblies are often difficult to assemble and are subjected to wear and rust over time. This can cause some of the elements to break or disengage thus rendering the door latch handle inoperative and in need of repair. Also, rust marks on the face plate are unpleasing to the eye. Because the face plate can have variations in thickness, this can result in a loose mounting assembly causing the handle to wobble. Still further, from periodic use, the metal component parts which rub about the front and rear face of the face plate cause wear to the face plate and therefore resulting in wear and a loose connection between the handle and the face plate and this is undesirable. Such problems also occur with the deadbolt turnpiece handle which is connected to the face plate, such as illustrated in the above-referenced U.S. Pat. No. 7,188,873. When these handles become loose due to the wear in the opposed faces of the face plate about the mounting hole, the handle becomes loose and wobbles and therefore does not rest at a normal level position. This also causes rattling in the door handle assembly and in an attempt to remedy these problems various types of washer configurations have been suggested and this further complicates the assembly of the door handle and results in further parts, therefore increasing the risk of failure.

SUMMARY OF THE INVENTION

It is a feature of the present invention to provide a door handle mounting system which substantially overcomes the above-mentioned disadvantages of the prior art.

Another feature of the present invention is to provide a door handle mounting system wherein the shank portion of the door handle is retained captive behind the face plate by a retainer ring formed of flexible polymer material having a memory, such as nylon, and which exerts a constant pulling force on the shank portion of the handle whereby the handle annular shoulder is biased against the outer face of the face plate about the handle mounting hole.

Another feature of the present invention is to provide a door handle mounting system wherein a coupling sleeve is secured to the shank portion of the handle and projects through the mounting hole on the front face of the face plate and is adapted to be retained and biased in the handle mounting hole by a retainer ring formed of flexible material having a memory.

Another feature of the present invention is to provide a door handle mounting system which is easy to install in the face plate through a handle mounting hole.

Another feature of the present invention is to provide a door handle mounting system having a door handle and a deadbolt turnpiece handle each retained in a respective mounting hole formed in a face plate and held captive therein by a respective retainer ring formed of flexible material having a memory.

Another feature of the present invention is to provide a door handle mounting system wherein the handle is retained in a face plate through a handle mounting hole by one or two non-metallic flexible retaining members.

Another feature of the present invention is to provide a door handle mounting system which includes a retainer ring which applies a pulling force on the shank portion of the handle whereby to compensate for variations in the thickness of the face plate to prevent the handle from being loosely mounted or exhibiting wobbly motion.

According to the above features, from a broad aspect, the present invention provides a door handle mounting system comprising a face plate having a handle mounting hole therein. A handle having a shank portion having engageable means is also provided. Circumferential abutment means is associated with the handle for abutment about the mounting hole on an outer face of the face plate when the shank portion is disposed thereinto. A retainer ring, formed of flexible non-metallic material having a memory, is adapted for engagement with the shank portion adjacent a rear face of the face plate. The retainer ring, has an integrally formed locking portion for locking engagement with the engageable means and an integrally formed tensioning portion for flexible engagement with the rear face of the face plate to apply a pulling force on the shank portion while retaining the handle operationally secured to the face plate.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 1A:
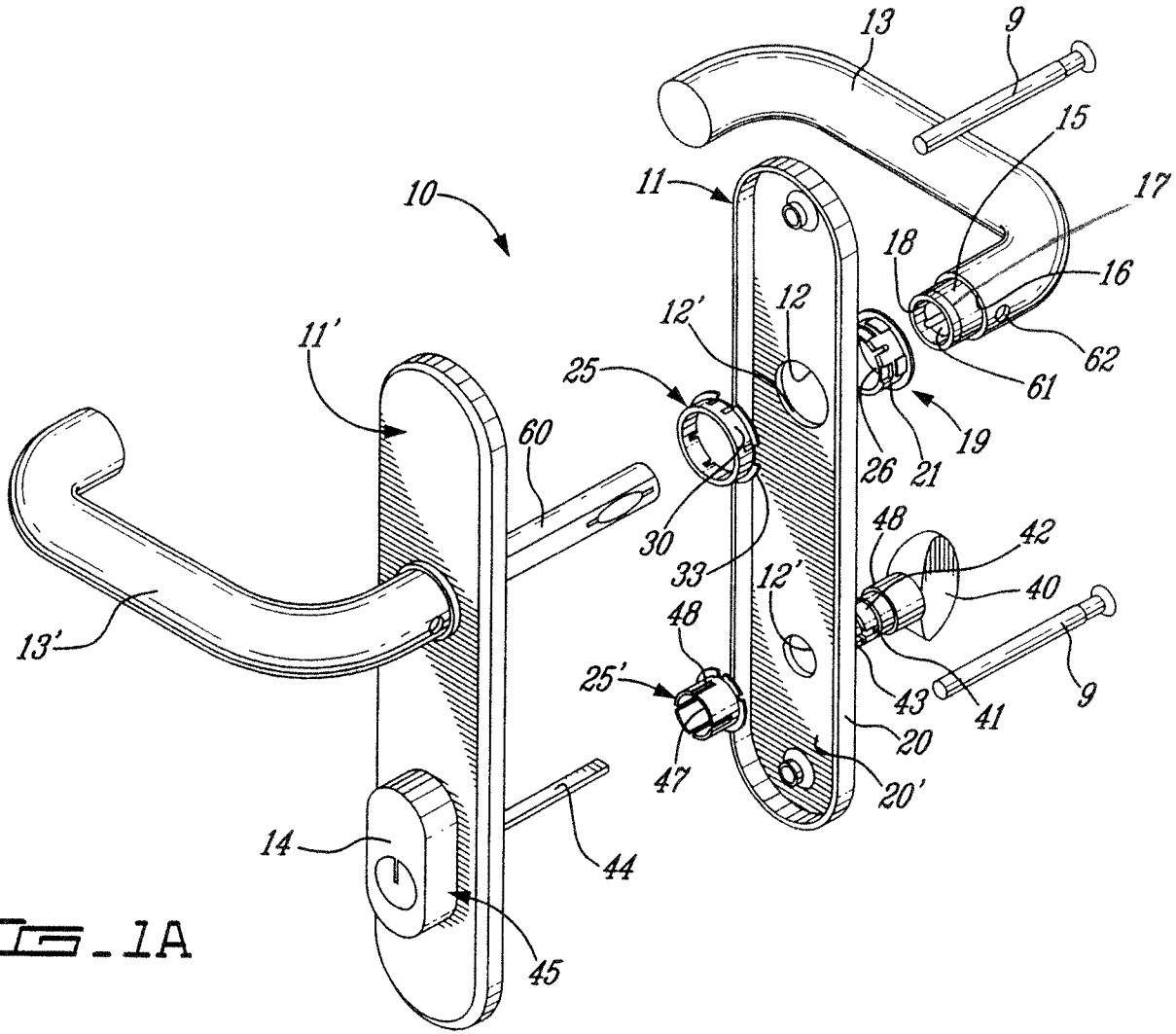
FIG. 1A is a perspective explosive view illustrating one example of a door handle set incorporating the door handle mounting system of the present invention wherein a coupling sleeve is secured to the handle shank and adapted to be engaged by a retainer ring.

Referring now to the drawings, and more particularly to FIG. 1A, there is shown generally at 10 a door handle set which is adapted to be mounted on opposed sides of a door by attachment bolts 9. The door handle set 10 is comprised of a pair of face plates 11 and 11', each provided with handle mounting holes 12 for connecting handles 13 and 13' thereto. One of the face plates 11 and 11' is an external face plate 11' while the other is an internal face plate 11. A keylock 14 is associated with the external face plate 11'. The external face plate assembly is part of the prior art.

The door handle mounting system of the present invention will be described with relation to the door handle 13 secured to the face plate 11. As herein shown the handle 13 is provided with a shank portion 15 which is hereinshown as being of cylindrical shape and of smaller diameter than the circumference of the handle 13 and it projects from an annular shoulder 16 formed with the handle. The shank portion 15 is hereinshown as being provided with engageable means in the form of a circumferential groove 17 located at a predetermined spacing from the free end 18 of the shank portion 15. Engageable means in the form of a coupling sleeve 19 is adapted to interlock with the shank portion in the example of FIG. 1A.

Figure 2:
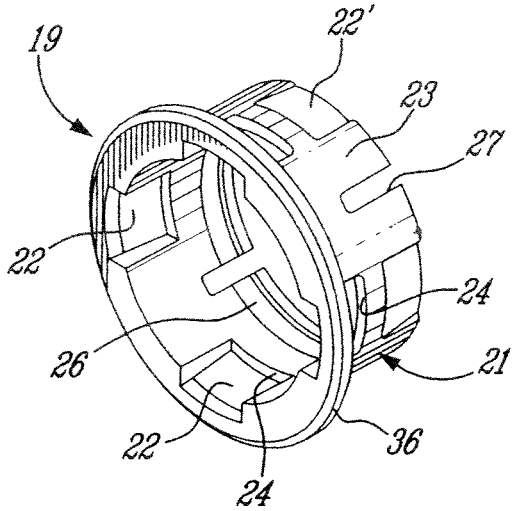
FIG. 2 is a perspective view illustrating the construction of the coupling sleeve adapted to be secured to the shank portion of the door handle as shown in FIG. 1A.
Figure 5:
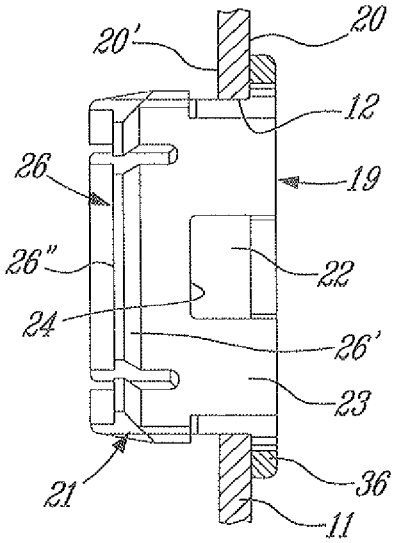
FIG. 5 is a section view through the coupling sleeve of FIG. 2 showing its position in the mounting hole of a face plate.

With further reference to FIGS. 2 and 5, it can be seen that the coupling sleeve 19 is a cylindrical sleeve and it is dimensioned for close fit in the face plate handle mounting hole 12 from the outer face 20 of the face plate 11. It also has an engageable cylindrical portion 21 for projecting behind the face plate 11 as better illustrated in FIG. 5. As better seen from FIGS. 2 and 5, the engageable cylindrical portion 21 is provided with spaced-apart engageable formations or openings 22 formed in the cylindrical side wall 23 thereof. Alignment ramps 22' are formed in the side wall 23 to align a retainer ring 25 thereon. These engageable openings 22 each have an engageable edge 24 adapted to be engaged by a retainer ring 25, as will be described later with reference to FIG. 3A. The coupling sleeve 19 is further provided with a shank attachment means in the form of a circumferential rib 26 adapted for engagement within the circumferential groove 17 of the shank portion 15. The cylindrical side wall is also provided with slots 27 to provide for the side wall 23 to flex outwardly. The coupling sleeve 19 is formed of a flexible polymer material having a memory, such as nylon, whereby when the coupling sleeve 19 is pushed over the shank portion 15, the side wall will flex to permit the circumferential rib 26 to enter into the circumferential groove 17 and being retained therein due to the memory aspect of the coupling sleeve as well as the circumferential inner side edge 12' of the handle mounting hole 12 being in close fit with the coupling sleeve. The rib 26 has a sloped side wall 26' and a transverse sidewall 26", as shown in FIG. 5, to permit ease of sliding displacement over the shank portion but preventing removal once engaged in the groove 17. The flexible side wall 21 also provides flexing to facilitate the connection of the retainer ring over the shank portion, as will now be described. The coupling sleeve 19 is secured to the shank portion of the door handle and then located in the mounting hole of the face plate to be engaged by the retainer ring 25 from the back side of the face plate 11.

Figure 3A:
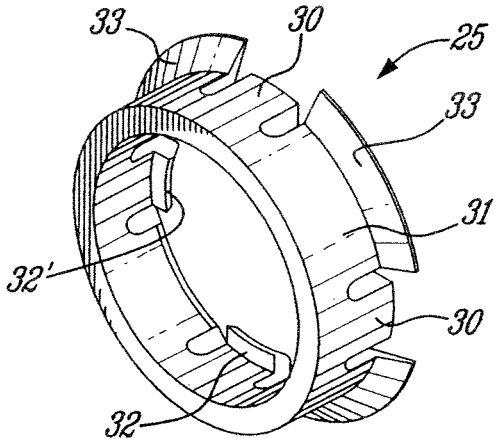
FIG. 3A is a perspective view illustrating the construction of the retainer ring adapted to be secured to the coupling sleeve of FIG. 2.
Figure 6:
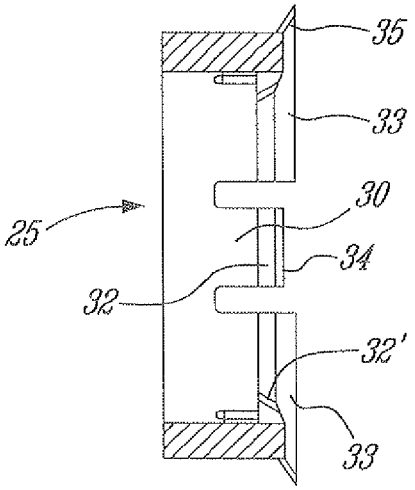
FIG. 6 is a sectional fragmented view, partly fragmented, through the retainer ring of FIG. 3A.
Figure 8:
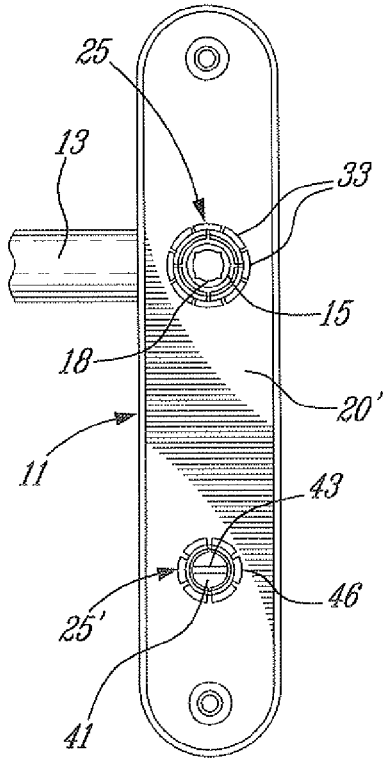
FIG. 8 is a rear fragmented view of a face plate showing the retainer ring secured to the shank portion of a door handle as well as a retainer ring secured to the shank portion of a deadbolt turnpiece handle.

With reference to FIGS. 1, 3A and 6, there is shown the construction of the retainer ring 25. As hereinshown the retaining ring 25 is an annular ring also formed of flexible polymer material having a memory, such as nylon, and is dimensioned for engagement over the engageable cylindrical portion 21 of the coupling sleeve 19. Such an engagement is shown in FIG. 8. The retainer ring 25 is provided with an integrally formed locking portion constituted by engaging fingers 30 formed integral with the circumferential side wall 31 of the retainer ring. As hereinshown, there are four flexible engaging fingers (but there could be three, four or six of these), two of which are disposed on transverse diametrical axes of the ring and each engaging finger has an internally projecting hook end 32 for clamping engagement with a respective one of the engageable edges 24 of the coupling sleeve 19 when the retainer ring 25 is pushed over the engageable, cylindrical portion 21 of the coupling sleeve from the backside of the face plate 11. The retainer ring 25 is formed thicker than the side wall 21 of the coupling sleeve 19 and the hook end is formed with a beveled undertace 32' to slide along the ramps 22' and snap lock within an engageable opening 22.

The retainer ring 25 is also provided with an integrally formed tensioning portion in the form of flexible tapered shoulder portions 33 formed integral with the circumferential side wall 31 of the retainer ring 25 and disposed between the engaging fingers 30. The diameter of the side wall 31 is selected to prevent the side wall 23 to open and prevents the handle from being pulled out of the face plate 11. The flexible shoulder portions 33 are dimensioned for flexible frictional engagement with the rear face 20' of the face plate 11 when the retainer ring 25 is pushed over the engageable cylindrical portion 21 of the coupling sleeve with the hook ends 32 snapping into engagement with the engageable edge 24 of the engageable openings 22. Accordingly, the door handle is now retained in clamping engagement by the flexible shoulder portion 33 exerting an inner pulling force onto the coupling sleeve which is immovably secured to the shank portion and accordingly applying a pulling force on the shank of the handle 13.

As better seen from FIG. 6, the flexible shoulder portions 33 project beyond the free end 34 of the engaging fingers 30 and are provided with an outwardly projecting abutment wing free end portion 35 to provide contact with the rear face 20' of the face plate 11 about the handle mounting hole 12.

As shown in FIGS. 1A, 2 and 5, the coupling sleeve 19 has an integrally formed, outwardly projecting, circumferential flange 36 for abutment about a circumferential portion of the outer face 20 of the face plate 11 and this is better shown in FIG. 5.

Figure 1B:
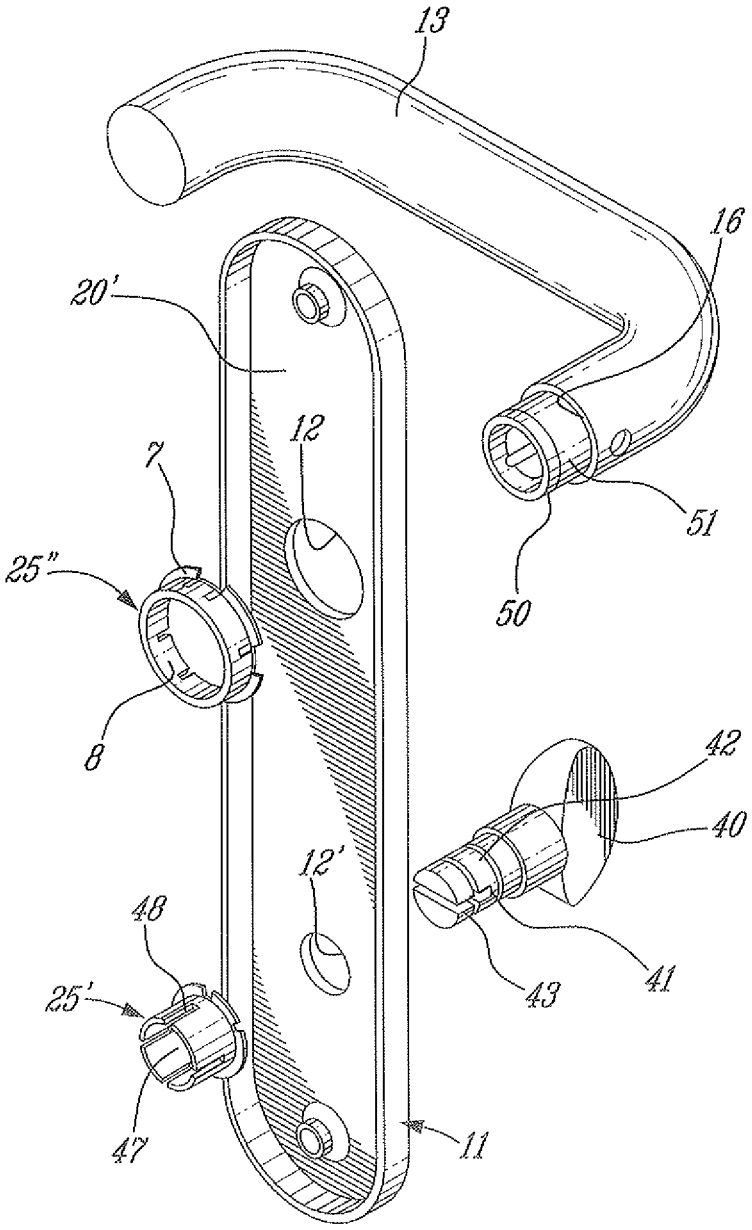
FIG. 1B is a perspective view similar to FIG. 1A but wherein the retainer ring is engageable with the handle shank without the use of a coupling sleeve.
Figure 3B:
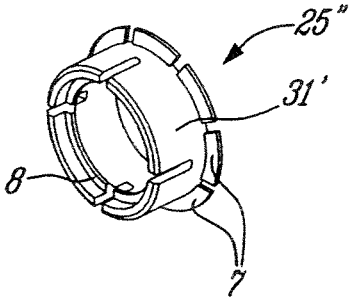
FIGS. 3B and 3C are perspective views illustrating a retainer ring specifically adapted for connection and securement to the shank portion of the door handle, as shown in FIG. 1A.
Figure 3C:
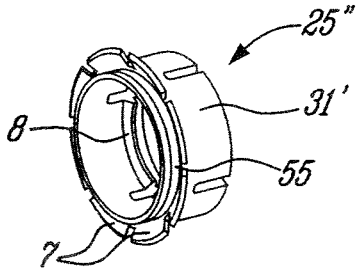
Figure 4B:
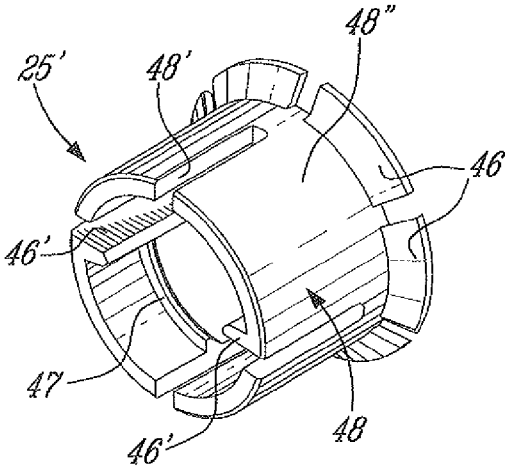
FIGS. 4A and 4B are perspective views showing a further modification of a retainer ring specifically adapted for connection and securement to the shank portion of a deadbolt turnpiece.
Figure 4A:
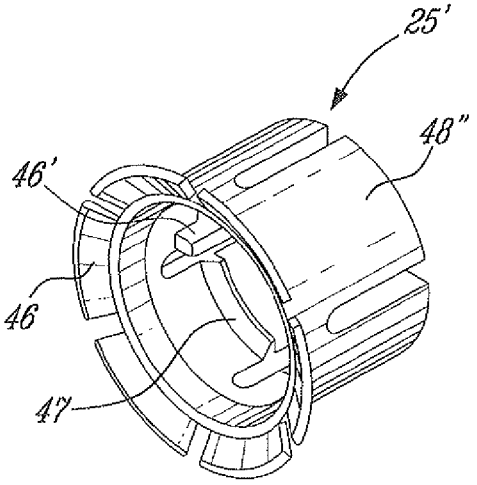

FIGS. 1B, 3B and 3C illustrate a modification of the retainer ring 25. As herein shown, the retainer ring 25" is constructed to connect directly to the circumferential groove 50 of the shank portion 51 of the door handle 13. The retainer ring 25" does not have engaging fingers but instead a circumferential inner rib 8 disposed and projecting inwardly from the side wall 31' of the ring 25". The side wall 31' is longer and dimensioned to permit the flexible shoulders 7 to flex against the rear surface 20' of the face plate 11 when the ring 25" is pushed over the shank portion until the rib 8 enters into the groove 50 of the shank portion 51 shown in FIG. 1B. Accordingly, the retainer ring 25" is sufficient to secure the handle to the face plate and applying retention force on the shank portion. The shoulder 16 of the handle 13 abuts the outer face 20 of the face plate 11 about the handle mounting hole 12. The rib 8 has a cross-section and functions as the circumferential rib 26 previously described.

With reference now to FIGS. 1A, 4A, 4B, 7A and 7B, there is also shown a further example of a handle being secured to a face plate by a retainer ring 25' formed in accordance with the present invention. As herein shown a deadbolt turnpiece handle 40 is provided with a shank portion 41 also provided with a circumferential groove 42 thereabout. The shank portion has a connecting slot 43 for receiving a deadbolt tailpiece 44 therein as is well known in the art and forming part of a standard deadbolt locking mechanism 45 as shown in FIG. 1A. The retainer ring 25' is provided with flexible shoulder portions 46 disposed substantially as with the retainer ring 25 and for engagement about the handle mounting hole and in contact with the rear face 20' of the face plate 11. The retainer ring 25' is provided with a circumferential ring 47 projecting inwardly of the side wall 48 of the retaining ring 25' and disposed for locking engagement within the circumferential groove 42 formed in the shank portion 41. The ring 47 is shaped as the circumferential ring 26 and once in the groove 42 it does not come out. The side wall 48 has grooves 48' formed therein to cause flexion of the sidewall portions 48". Adjacent two diametrically opposed grooves 48' there is provided two vertically projecting walls 46' which project on opposed edges of the connecting slot 43 of the shank portion 41 of the turnpiece handle 40 to retain the tailpiece 44 in alignment the shank portion and trapped therein, see FIG. 7B. Locking engagement is accomplished by pushing the retainer ring 25' over the shank portion 41 from the backside of the face plate when the shank portion 41 is positioned within the handle mounting hole 12' of the deadbolt turnpiece handle 40. Accordingly, the retainer ring 25' also interlocks the deadbolt turnpiece handle within its handle mounting hole 12' and exerts a pulling force on the shank portion 41 similar to that as previously described in connection with the retainer ring 25. The deadbolt turnpiece handle also has an annular shoulder 48 to abut about the front face 20 of the face plate about the handle mounting hole 12'.

Figure 7A:
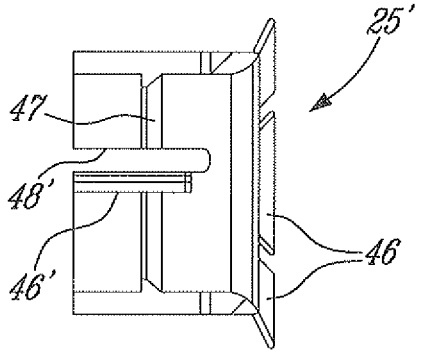
FIG. 7A is a section fragmented view of the retainer ring of FIGS. 4A and 4B.
Figure 7B:
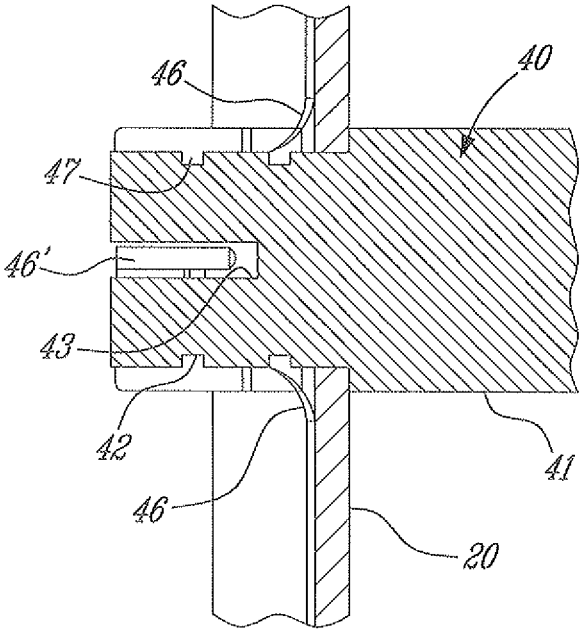
FIG. 7B is a section view showing the retainer ring of FIG. 7A secured to a shank of a deadbolt turn piece.
Figure 9:
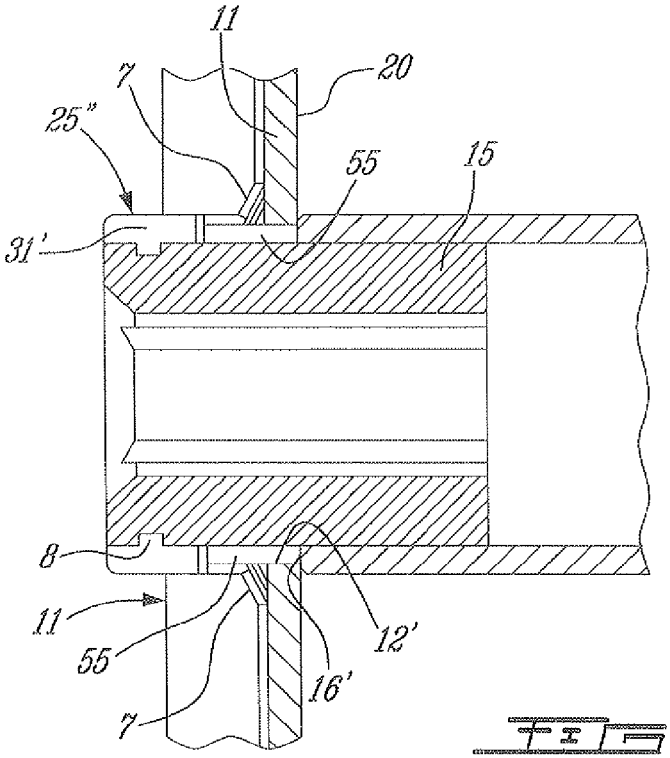
FIG. 9 is a fragmented side view showing the door handle of FIG. 1B wherein the circumferential abutment means is provided by an annular shoulder portion of the handle adapted for frictional engagement about the outer surface of a face plate about the handle mounting hole.

With reference to FIGS. 1B and 9, there is shown a further modification of the handle mounting assembly of the present invention. As hereinshown, the handle 13' may be retained within its handle mounting hole 12 without a coupling sleeve 19. For such an attachment, the retainer ring 25' would engage with the circumferential groove 50 provided in the shank portion 51 of the handle 13'. The attachment would be as shown in FIG. 7B.

FIGS. 3B, 3C and 9 illustrate a further modification of the retainer ring, herein retainer ring 25'. The ring 25" is provided with an annular projecting flange 55 projecting forwardly thereof. This ring 25" is used when the handle mounting hole 12', see FIG. 9, is larger than the diameter of the shank. This flange 55 keeps the shank centrally aligned with the hole 12'. The shoulder 16 of the handle 13 is thus centrally disposed about the hole to engage the outer surface 20 of the face plate 11.

With reference again to FIG. 1A it can be seen that the door handle 13 and the deadbolt turnpiece 40 can be preassembled to the face plate 11 ready to receive a respective one of a handle spindle 60 and the tailpiece 44. The handle 13, as hereinshown, is provided with a spindle receiving hole 61 in a free end thereof for receiving the spindle 60 in close fit therein. A countersunk Allen screw 62 secures the spindle 60 within the spindle receiving hole 61. Although not shown, the assembly 10 would include a torsion coil spring to bias the handles 13, 13' in a horizontal position.

It is pointed out that the door handle mounting system as herein described consists of very few parts, either a single retainer ring 25' or a combination of retainer ring 25 and coupling sleeve 19 whereby to secure handles 40 and 13, respectively, within respective handle mounting holes 12 and 12' of a face plate, respectively. These retainer rings have the features of being easily connectable to the shank portion, either directly thereto or through a coupling sleeve and also have the further feature of providing a pulling force on the shank portion to bias the annular shoulder of the handle against the face plate while retaining the handle operationally secured to the face plate. Because the retainer ring 25 and coupling sleeve 19 are formed of nylon material or other suitable like flexible material having a memory, there are no oxidizing parts in the connection of the shank portion of the handles 13 and 40 into their respective handle mounting holes 12 and 12' thus avoiding the formation of rust and the unsightly appearance that it can cause, particularly so on an outdoor face plate where such is exposed to high humidity, rain and snow. Further, the use of structural plastic eliminates the galvanic effect that is produced when different metals are placed in contact with one another. The retainer ring and the coupling sleeve isolate some of the metal parts from each other preventing such contact.

Another advantage in having fewer parts is that there are fewer parts which can be lost in kits wherein the parts are packaged in a loose form within a handle set package. Having fewer parts, it is also easier to ensure excellent quality control in the packaging of these door handle sets. It also provides for easier instructions for the installation of the handles to the face plate and the fact that the parts do not resemble one another further renders the assembly foolproof. As previously pointed out, because these face plates may vary in thickness, the assembly could result in loose or wobbly handle connections. Because the retainer ring 25 is provided with flexible shoulder portions 33, it will compensate for any variation in such face plate thicknesses while still exerting a pulling force on the shank portion of the handle.

It is within the ambit of the present invention to cover any obvious modifications of the preferred embodiment described herein, provided such modifications fall within the scope of the appended claims.

I claim:

1. A door handle mounting system comprising a door face plate having a handle mounting hole therein, a handle having a shank portion being cylindrical and projecting from a connecting end of said handle the shank portion having a longitudinal axis, said shank portion having engageable means on an outer face thereof in the form of a cylindrical groove positioned to be disposed spaced rearwardly of a rear face of said face plate, circumferential abutment means associated with said handle and extending about said shank portion for abutment about said mounting hole on an outer face of said face plate when said shank portion is disposed thereinto, a retainer ring being a single unitary piece formed of flexible, non-metallic material and having a circumferential side wall being adapted for engagement about said shank portion adjacent said rear face of said face plate, said circumferential side wall having an integrally formed engaging formation in the form of a ring projection integrally formed in an inner face thereof for locking and close-fit retention engagement with said engageable means for blocking movement of the retainer ring along the longitudinal axis of the shank portion, said circumferential side wall having an integrally formed flexible tensioning portion projecting outwardly from a circumferential edge of said circumferential side wall towards said rear face of said face plate for flexible and direct abutment with said rear face of said face plate, said engaging formation when in locking and retention engagement with said engageable means causing said tensioning portion to apply a pulling force in a direction parallel to the longitudinal axis on said shank portion to retain said handle operationally secured to said face plate with said circumferential abutment means pulled in a direction parallel to the longitudinal axis toward said mounting hole, said retainer ring has an annular projecting flange adapted to project about said cylindrical shank portion and into said handle mounting hole to substantially fill a space between said cylindrical shank portion and a circumferential edge of said handle mounting hole.

2. A door handle mounting system as claimed in claim 1 wherein there is further provided a coupling sleeve having a shank attachment formation for interlocking engagement with said engageable means formed in said shank portion.

3. A door handle mounting system as claimed in claim 2 wherein said coupling sleeve is a cylindrical sleeve dimensioned for close fit in said face plate handle mounting hole from said outer face of said face plate and having an engageable cylindrical portion for projection behind said face plate.

4. A door handle mounting system as claimed in claim 3 wherein said engageable cylindrical portion is provided with engageable formations for locking engagement with said engaging formation of said retainer ring.

5. A door handle mounting system as claimed in claim 4 wherein said engageable formations are constituted by spaced-apart engageable openings provided in a cylindrical side wall of said cylindrical sleeve, said engageable openings each having an engageable edge, said locking portion of said retainer ring being constituted by flexible engaging fingers formed integral with a circumferential side wall of said retainer ring, each said engaging fingers having a hook end for clamping engagement with a respective one of said engageable edges of said engageable openings of said cylindrical side wall of said cylindrical sleeve.

6. A door handle mounting system as claimed in claim 5 wherein there is further provided an alignment ramp formed in an outer surface of said cylindrical side wall and aligned with a respective one of said engageable openings to guide said engaging fingers with a respective one of said openings.

7. A door handle mounting system as claimed in claim 5 wherein said flexible tensioning portion of said retainer ring is constituted by flexible shoulder portions formed integrally with said circumferential side wall of said retainer ring between said flexible engaging fingers, said flexible shoulder portions being dimensioned for flexible frictional engagement with said rear face of said face plate about said handle mounting hole when said hook end of said engaging fingers is positioned in said clamping engagement by applying a pushing force on said retainer ring over said engageable cylindrical portion of said coupling sleeve.

8. A door handle mounting system as claimed in claim 7 wherein said flexible shoulder portions are projecting shoulder portions extending beyond a free end of said flexible engaging fingers.

9. A door handle mounting system as claimed in claim 8 wherein each said projecting shoulder portions are provided with an outwardly projecting abutment wing free end portion.

10. A door handle mounting system as claimed in claim 2 wherein said coupling sleeve is formed of flexible non-metallic material having a memory; said coupling sleeve having an integrally formed outwardly projecting, circumferential flange for abutment about a circumferential portion of said outer face of said face plate about said mounting hole.

11. A door handle mounting system as claimed in claim 10 wherein said coupling sleeve and said retainer ring are formed of a plastic resin material.

12. A door handle mounting system as claimed in claim 1 wherein said handle is a lever handle.

13. A door handle mounting system as claimed in claim 1 wherein said circumferential abutment means comprises an annular shoulder formed with said handle about an inner end of said shank portion for frictional sealing engagement about said handle mounting hole.

14. A door handle mounting system as claimed in claim 1 wherein said handle is a deadbolt turnpiece handle, said shank portion having a connecting slot therein for receiving a deadbolt tailpiece therein of a deadbolt locking mechanism, said retainer ring having diametrically opposed projecting walls projecting from an inner surface of a cylindrical wall of said ring and dimensioned to project partly into said connecting slot from opposed sides thereof to retain a free end portion of said tailpiece captive in alignment therein.

* * * * *